US007886466B2

(12) United States Patent
Golle

(10) Patent No.: US 7,886,466 B2
(45) Date of Patent: Feb. 15, 2011

(54) METHOD AND APPARATUS FOR WRAPPING TRAIN WITH ADVERTISEMENT ELECTROLUMINESCENT LIGHTING

(75) Inventor: Aaron J. Golle, Shakopee, MN (US)

(73) Assignee: Safe Lites, LLC, Eden Prairie, MN (US)

( * ) Notice: Subject to any disclaimer, the term of this patent is extended or adjusted under 35 U.S.C. 154(b) by 0 days.

(21) Appl. No.: 12/441,336

(22) PCT Filed: Sep. 13, 2007

(86) PCT No.: PCT/US2007/019936

§ 371 (c)(1),
(2), (4) Date: Mar. 13, 2009

(87) PCT Pub. No.: WO2008/033470

PCT Pub. Date: Mar. 20, 2008

(65) Prior Publication Data

US 2009/0249664 A1 Oct. 8, 2009

Related U.S. Application Data

(60) Provisional application No. 60/825,552, filed on Sep. 13, 2006.

(51) Int. Cl.
*G09F 13/22* (2006.01)
*G09F 21/04* (2006.01)

(52) U.S. Cl. ..... 40/591; 40/544; 40/556; 40/590

(58) Field of Classification Search ..... 40/544, 40/591

See application file for complete search history.

(56) References Cited

U.S. PATENT DOCUMENTS

| | | | | |
|---|---|---|---|---|
| 1,803,439 | A | 5/1931 | Rosenstein | |
| 1,974,039 | A | 9/1934 | Bohannon et al. | |
| 2,095,350 | A | 10/1937 | Soule | |
| 2,122,766 | A | 7/1938 | Wiemar | |
| 3,629,906 | A | 12/1971 | Gasser | |
| 5,005,306 | A | 4/1991 | Kinstler | |
| 5,485,145 | A * | 1/1996 | Sniff | 340/815.4 |
| 5,518,561 | A | 5/1996 | Rosa | |
| 6,168,115 | B1 | 1/2001 | Abdelkhaleq | |

(Continued)

FOREIGN PATENT DOCUMENTS

| | | |
|---|---|---|
| GB | 463196 | 3/1937 |

(Continued)

OTHER PUBLICATIONS

"Application Serial No. PCT/US2007/019936, International Search Report mailed Sep. 22, 2008", 11 pgs.

*Primary Examiner*—Cassandra Davis
(74) *Attorney, Agent, or Firm*—Schwegman, Lundberg & Woessner, P.A.

(57) ABSTRACT

Method and apparatus provide for attaching a planar electroluminescent lamp unit (140*a*-140*g*) to the side (138) of a train (100), and providing a film (120) adhered to the surface of the lamp unit (140*a*-140*g*) and to the side of the train adjacent the lamp unit, wherein the film has printed thereon advertising indicia (130*a*-130*d*). The lamp unit is connected to a source of power on the train.

20 Claims, 4 Drawing Sheets

U.S. PATENT DOCUMENTS

| | | | |
|---|---|---|---|
| 6,283,414 | B1 | 9/2001 | Quinones et al. |
| 6,527,607 | B1 | 3/2003 | Huang |
| 6,698,122 | B1 | 3/2004 | Merenlender |
| 7,065,910 | B2 | 6/2006 | Woodruff |
| 7,296,371 | B2 | 11/2007 | Schimanz |
| 7,364,315 | B2 | 4/2008 | Chien |
| 7,406,787 | B2 | 8/2008 | Smith et al. |
| 2004/0114349 | A1 | 6/2004 | Golle et al. |
| 2006/0207139 | A1 | 9/2006 | Deflin et al. |
| 2009/0211132 | A1 | 8/2009 | Rosa et al. |

FOREIGN PATENT DOCUMENTS

| | | | |
|---|---|---|---|
| WO | WO-0152225 | A1 | 7/2001 |

* cited by examiner

METHOD AND APPARATUS FOR WRAPPING TRAIN WITH ADVERTISEMENT ELECTROLUMINESCENT LIGHTING

RELATED PATENT APPLICATIONS

This patent application is a U.S. National Stage Filing under 35 U.S.C. 371 from International Patent Application Serial No. PCT/US2007/019936 filed Sep. 13, 2007, and published on Mar. 20, 2008 as WO 2008/033470, which claims priority benefit under 35 U.S.C. 119(e) of U.S. Provisional Patent Application Ser. No. 60/825,552 filed Sep. 13, 2006 and entitled METHOD AND APPARATUS FOR WRAPPING TRAIN WITH ADVERTISEMENT INCLUDING ELECTROLUMINESCENT LIGHTING; which applications and publication are incorporated herein by reference in their entirety and made a part hereof.

FIELD OF THE INVENTION

The present invention relates to method and apparatus for wrapping a vehicle with a sheet of material carrying an advertisement, such as one or more images and/or text for the advertisement, wherein there are provided electroluminescent portions of the advertisement.

DETAILED DESCRIPTION OF THE INVENTION

Figure 1:
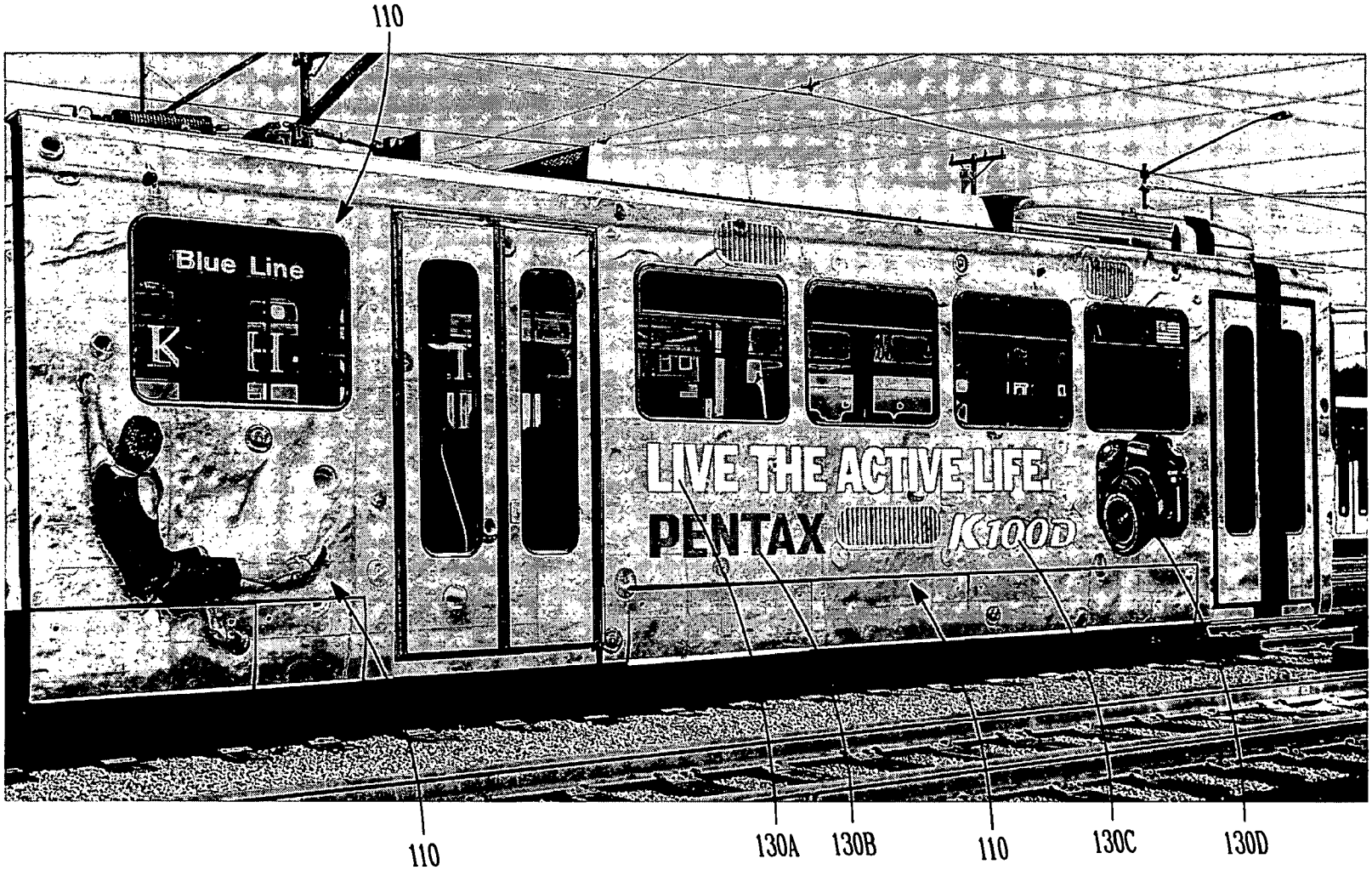
FIG. 1 is a view of an apparatus according to example embodiments of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, electrical changes, etc. may be made without departing from the scope of the present invention.

Figure 2A:
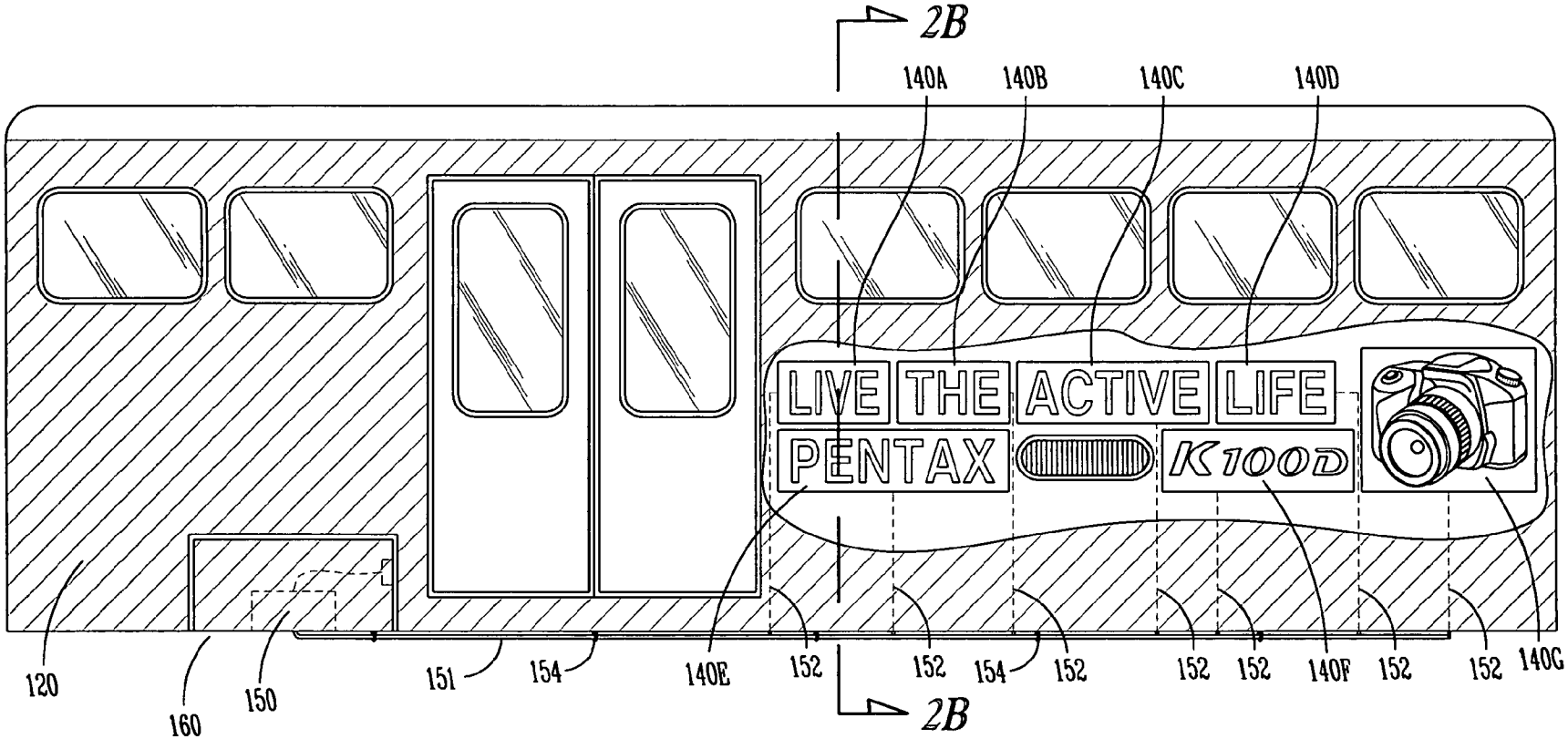
FIG. 2A is a schematic view of an apparatus according to example embodiments of the invention.
Figure 2B:
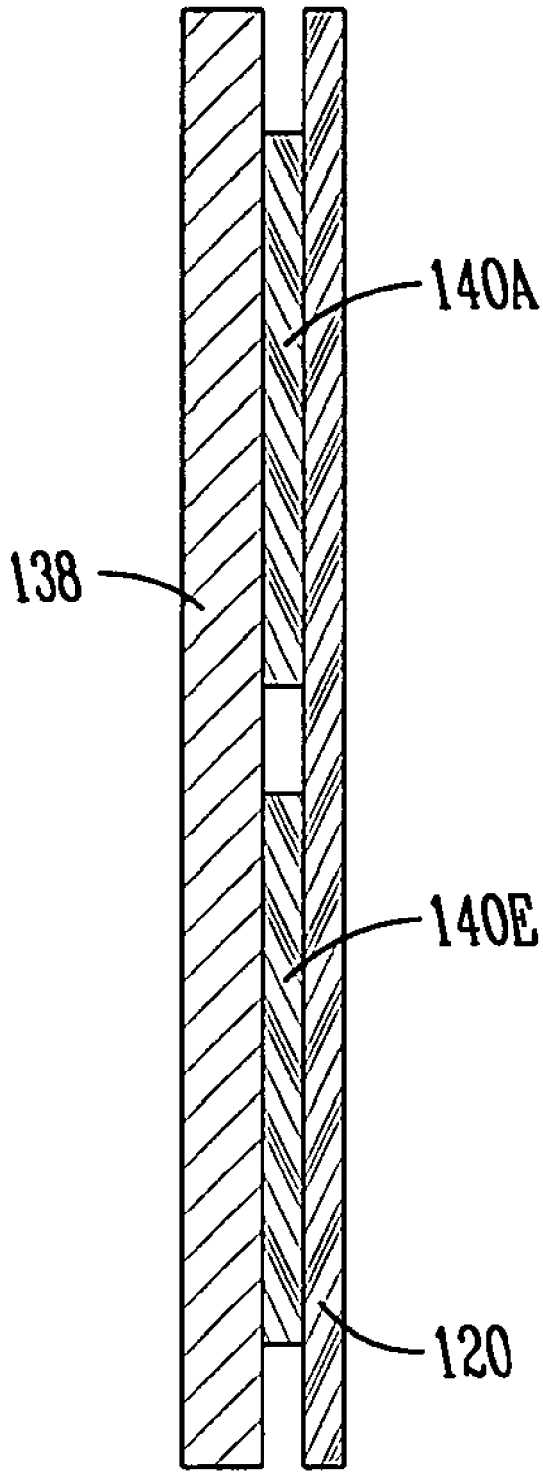
FIG. 2B is a cross sectional taken generally along line 2B-2B of FIG. 2A.

Referring now to FIGS. 1, 2A and 2B there is illustrated a train 100 "wrapped" with advertising indicia 110 carried on a film 120. In the instant example, the advertising indicia 110 is for a camera, and depicts a climbing wall together with the slogan "LIVE THE ACTIVE LIFE" 130*a*, the manufacturer's name PENTAX 130*b*, the name of the camera line or product "K100D" 130*c* and a depiction of the camera 130*d*. In the example, indicia 130*a* to 130*d* are illuminated with planar electroluminescent (EL) lamps that are disposed on the surface of the train under the film 120. According to one embodiment, indicia 130*a* and 130*c* and the white portions of the depiction of camera 130*d* may be illuminated by white or light colored EL lamps, while indicia 130*b* may be illuminated with an EL lamp producing an orange color. According to another example embodiment, the entire depiction of the camera 130*d* may be illuminated by an EL lamp. According to one example embodiment, the orange color or the white colors may be produced by the EL light produced directly by the lamps or by the light produced by the lamp and filtered through a colored transparent overlay, for example but not limited to as shown in U.S. Pat. No. 6,769,138 to Golle, incorporated herein by reference.

Referring to FIGS. 2A and 2B, train 100 is shown with the film 120 cut away exposing EL lamp units 140*a* to 140*g* with in this example embodiment are rectangular, and carry the respective EL illuminated indicia 130*a* to 130*d*. Lamp units 140 are each rectangular, planar lamp assemblies that include planar EL lamps. In one embodiment, the EL lamps are formed in the shape of the alphanumeric characters of indicia 130*a* to 130*d*. In another embodiment, the lamp units 140 are covered with a mask that exposes only the alphanumeric characters of indicia 130*a* to 130*d*, such that the entire surface area of the lamp units 140 produces EL light but only the area exposed the mask is visible.

As illustrated in FIG. 2B, each of the planar lamp units 140*a* to 140*g* are attached to the side 138 of the train 100 using an adhesive or any other suitable attachment. The film 120 (indicated by hashing) is then applied over the side of the train and the lamp units 140*a* to 140*g*, adhering to the side of the train and to the top of the lamp units 140*a* to 140*g*. The film may then be removed from over the indicia 130*a* to 130*d* so that only the alphanumeric characters or the camera depiction are exposed and the remaining portions of the lamp units 140*a* to 140*g* are covered by the film 120. Alternatively, the alphanumeric characters may be left covered by the film 120 but the film 120 is thin enough or translucent enough to allow the EL illuminated indicia to shine through it or be visible when the illumination is not active.

Figure 3:
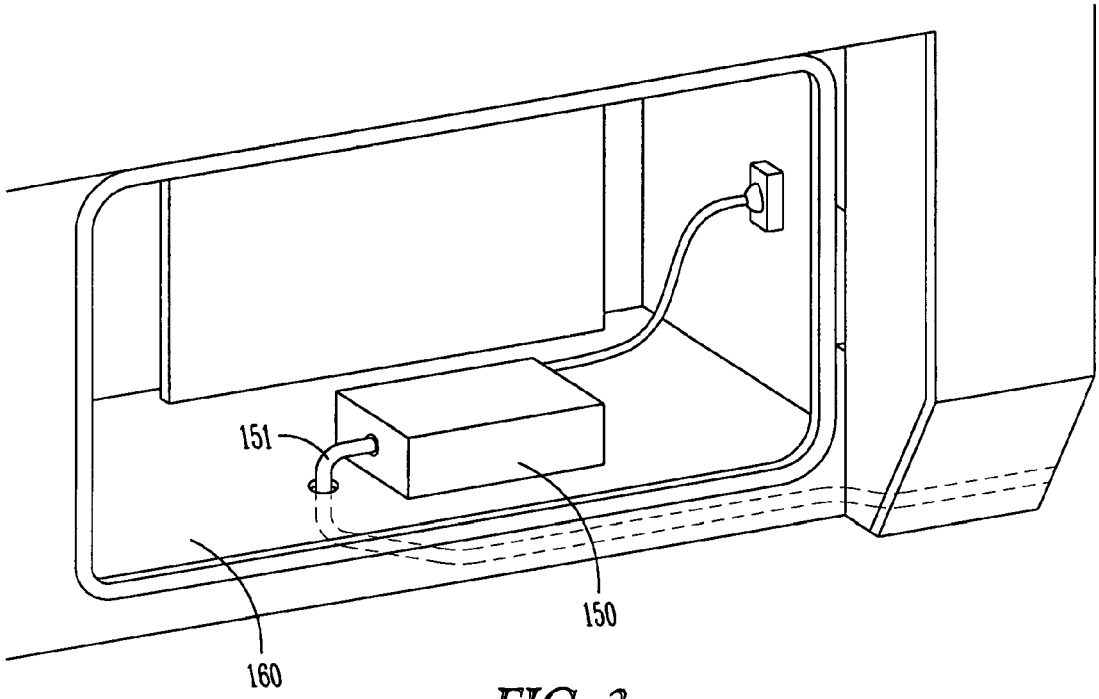
FIG. 3 is a partial view of an apparatus according to example embodiments of the invention

Referring now to FIGS. 2A and 3, the EL lamp units 140*a* to 140*g* are each connected to a source of energy produced by a power and control unit 150. The connection to unit 150 is provided by individual conductors 152 (four for each lamp unit 140*a* to 140*g*, carrying power and ground to, in one embodiment, opposite sides or ends of the lamp units). Conductors 152 may leave unit 150 wrapped as a single bundle 151, and leave the bundle 151 to run to the respective units 140*a* to 140*g*. Accordingly, units 140*a* to 140*g* may each have its own separate power lines. Alternatively, a single bus may be used to run power to each unit 140*a* to 140*g*, although such an arrangement does not allow for controlling the illumination of each unit 140*a* to 140*g* individually.

Power and control unit 150 is housed in a wiring or electrical compartment 160 on the train 100, and is connected to a master power source, such as a 110 volt power supply or any suitable master power supply. Cable bundle 151 runs from the unit 150 through an aperture in the floor of the compartment and to the underside of the train and runs along the side edge on the bottom of the train undercarriage, for example held in place with fasteners 154 that may be attached to any suitable portion of the undercarriage.

Figure 4:
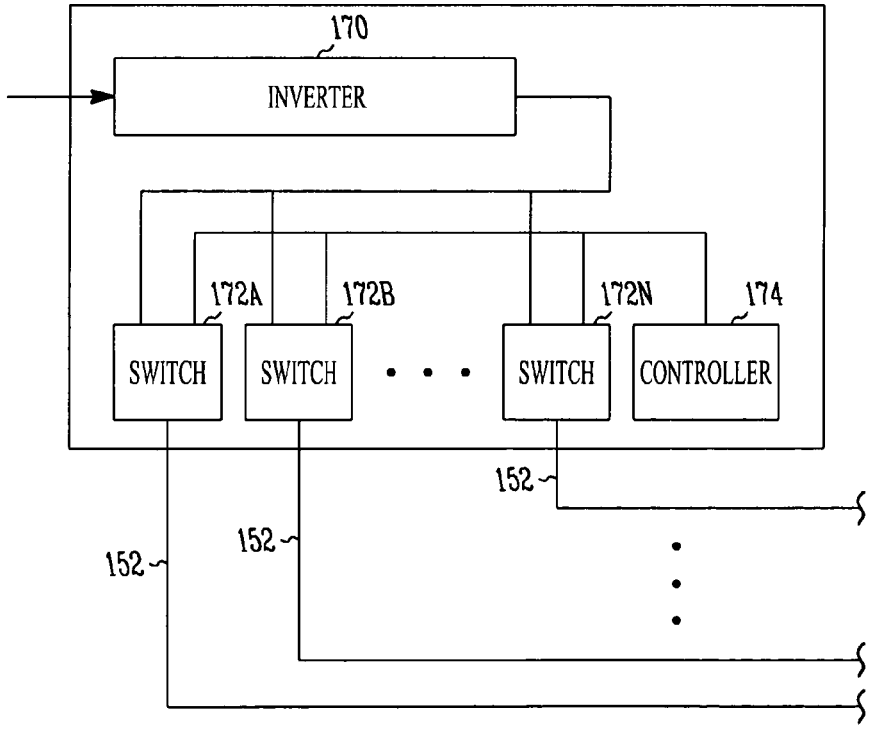
FIG. 4 is a schematic according to example embodiments of the invention

According to still another example embodiment, the power and control unit 150 is shown in more detail in FIG. 4. Unit 150 includes a power inverter 170 that supplies power to conductors 152 through switches 172*a* through 172*n*. Switches 172 are in turn controlled by a computer control device or other controller device 174 that may sequentially activate switches 172*a* through 172*n* and then, for example, activate them all in combination. In another embodiment, each switch may be activated in sequence and left on until all other switches are activated, and leaving all activated for a period of time until all are deactivated. According to another example embodiment, the switches may be deployed remotely from the unit 150, such as on the undercarriage of the train or adjacent the lamp unit 140, and a control line for the switch run from the control unit to the switch.

According to one example embodiment, suitable materials for use as the film 120 include various sheets, preferably comprised of thermoplastic or thermosetting polymeric materials, such as films, providing a substrate to carry the advertising indicia 110, in this example an advertisement for a camera. Further, such films may, in one example embodiment, be low surface energy substrates. "Low surface energy" refers to materials having a surface tension of less than about 50 dynes/cm (also equivalent to 50 milliNewtons/meter). The polymeric substrates are typically nonporous. However, microporous, apertured, as well as materials further comprising water-absorbing particles such as silica and/or superabsorbent polymers, may also be employed provided the substrate does not deteriorate or delaminate upon expose to water and temperature extremes, as previously described. Other suitable substrates include woven and nonwoven fabrics, particularly those comprised of synthetic fibers such as polyester, nylon, and polyolefins. The substrates as well as the imaged article (e.g. sheets, films, polymeric materials) may be clear, translucent, or opaque. Further, the substrate and imaged article may be colorless, comprise a solid color or comprise a pattern of colors. Additionally, the substrate and imaged articles (e.g. films) may be transmissive, reflective, or retroreflective.

Representative examples of polymeric materials (e.g. sheet, films) for use as the substrate 120 include single and multi-layer constructions of acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Further, the substrate may comprise copolymers of such polymeric species. Other particular films for use as the substrate according to the inventive subject matter include multi-layered films having an image reception layer comprising an acid- or acid/acrylate modified ethylene vinyl acetate resin, as disclosed in U.S. Pat. No. 5,721,086 (Emslander et al.). The image reception layer comprises a polymer comprising at least two monoethylenically unsaturated monomeric units, wherein one monomeric unit comprises a substituted alkene where each branch comprises from 0 to about 8 carbon atoms and wherein one other monomeric unit comprises a (meth) acrylic acid ester of a nontertiary alkyl alcohol in which the alkyl group contains from 1 to about 12 carbon atoms and can include heteroatoms in the alkyl chain and in which the alcohol can be linear, branched, or cyclic in nature. A preferred film for increased tear resistance includes multi-layer polyester/copolyester films such as those described in U.S. Pat. Nos. 5,591,530 and 5,422,189. Depending of the choice of polymeric material and thickness of the substrate, the substrate (e.g. sheets, films) may be rigid or flexible. Preferred primer and ink compositions are preferably at least as flexible as the substrate. "Flexible" refers to the physical property wherein imaged primer layer having a thickness of 50 microns can be creased at 25 C. without any visible cracks in the imaged primer layer.

Commercially available films include a multitude of films typically used for signage and commercial graphic uses such as available from 3M under the trade designations "Panaflex", "Nomad", "Scotchcal", "Scotchlite", "Controltac", and "Controltac Plus". According to one example embodiment, the train 100 may be wrapped with 3M™ Controltac™ Plus Graphic Film with Comply™ Performance IJ180C-10, printed on roll having, for example, a width of 54 in and a length of 50 yd. This 2 mil, opaque film to produces high quality, long-term graphics with selected piezo ink jet printers. The film 120 may pressure-activated adhesive and 3M Comply™ Performance for easier installation of large fleet graphics, signs, emblems and more. In another embodiment, the film 120 may be 3M Scotchcal™ Luster Overlaminate 8519, 2 mil with PSA, 54 in×300 ft.

Primer compositions and optional barrier compositions applied to substrate 120 are made by mixing together the desired ingredients using any suitable technique. For example, in a one step approach, all of the ingredients are combined and blended, stirred, milled, or otherwise mixed to form a homogeneous composition. As another alternative, some of the components may be blended together in a first step. Then, in one or more additional steps, the remaining constituents of the component if any, and one or more additives may be incorporated into the composition via blending, milling, or other mixing technique. During the manufacture of the substrate 120, the primer composition may be applied to a surface of the substrate or to the optional barrier layer. The primer may be applied with any suitable coating technique including screen printing, spraying, ink jetting, extrusion-die coating, flexographic printing, offset printing, gravure coating, knife coating, brushing, curtain coating, wire-wound rod coating, bar coating and the like. The primer is typically applied directly to the substrate. Alternatively, the primer may be coated onto a release liner and transfer coated onto the substrate. However, for embodiments wherein the primer surface is exposed and thus is non-tacky, additional bonding layers may be required. After being coated, the solvent-based primer compositions and optional barrier compositions are dried. The coated substrates are preferably dried at room temperature for at least 24 hours. Alternatively the coated substrates may be dried in a heated oven ranging in temperature from about 40° C. to about 70° C. for about 5 to about 20 minutes followed by room temperature drying for about 1 to 3 hours. For embodiments wherein a barrier layer is employed, it is preferred to employ a minimal thickness of primer to minimize the drying time.

The imaged, polymeric sheets may be a finished product or an intermediate and are useful for a variety of articles including signage and commercial graphics films. The commercial graphic films as for example shown in FIG. 1 as substrate 120 may include a variety of advertising, promotional, and corporate identity imaged films. The films typically comprise a pressure sensitive adhesive on the non-viewing surface in order that the films can be adhered to a target surface such as an automobile, truck, airplane, billboard, building, awning, window, floor, etc. Alternatively, imaged films lacking an adhesive are suitable for use as a banner, etc. that may be mechanically attached to building, for example, in order to display. The films in combination with any associated adhesive and/or line range in thickness from about 5 mils (0.127 mm) to as thick as can be accommodate by the printer (e.g. ink jet printer). According to one example embodiment, printing on the films 120 may be done using the Xaar Jet XJ128-200 piezo printhead on an x-y stage at 317 by 295 dpi at room temperature.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

The invention claimed is:

1. A method comprising:

attaching at least one planar electroluminescent lamp unit to a side of a vehicle;

attaching a power bus to the planar electroluminescent lamp;

disposing adhesive on a thermosetting low surface energy film and overlaying the low surface energy film over the at least one planar electroluminescent lamp unit and a side of the vehicle adjacent the at least one planar electroluminescent lamp unit by adhering the adhesive to the vehicle, wherein the film is translucent and has printed thereon advertising indicia;

thermosetting the low surface energy film such that the vehicle is wrapped by the film and resists delamination when exposed to water;

connecting the lamp unit to a source of power on the vehicle, wherein the source of power on the vehicle comprises a power source, and the power bus includes a plurality of individual power lines to carry power to the at least one lamp unit; and switching the power source to control illumination of the planar electroluminescent lamp unit to shine through the film.

2. A method according to claim 1 wherein the film is thermoplastic.

3. A method according to claim 2 wherein the film comprises a low surface energy substrate.

4. A method according to claim 1 wherein the lamp is shaped to form a component of the indicia on the film.

5. Apparatus comprising:

a vehicle;

a source of power mounted on the vehicle and adapted to illuminate one or more electroluminescent (EL) lamps lamp;

an at least partially bundled power bus including a plurality of conductors to carry power to respective EL lamps, the conductors including respective connectors to allow for detachable connection to an EL lamp;

a plurality of planar EL lamps disposed on a side of the vehicle and including respective connectors to detachably connect to respective ones of the plurality of conductors; and a film adhered over a surface of the lamps and over a side of the vehicle adjacent the lamps, wherein the film includes a translucent portion and has printed thereon advertising indicia and wherein the film is thermoset and wraps the vehicle and is adapted to resist delamination when exposed to water, wherein the source of power is adapted to illuminate the one or more EL lamps to shine through the translucent portion of the film.

6. A method according to claim 5 wherein the film is thermoplastic.

7. Apparatus according to claim 6 wherein the film comprises a low surface energy substrates.

8. Apparatus according to claim 5 wherein at least one of the plurality of planar EL lamps is shaped to form a component of the indicia on the film.

9. Apparatus according to claim 5 wherein the power source includes a control unit including a power inverter and a plurality of switches to selectively connect the power inverter to individual connectors on the power bus.

10. Apparatus according to claim 9 further including a program adapted to sequence the switches to cause the EL lamps to illuminate in sequence or combination.

11. The apparatus of claim 5, wherein a portion of the film is translucent.

12. The apparatus of claim 11, wherein a portion of the film is opaque.

13. The apparatus of claim 12, wherein a portion of the film is clear.

14. A method comprising:

attaching a planar electroluminescent lamp unit to a side of a train;

attaching a power bus to the planar electroluminescent lamp;

disposing adhesive on an at least partially translucent polymeric film and adhering the adhesive of the film to a surface of the lamp unit and to the side of the train adjacent the lamp unit;

thermosetting the film such that the translucent polymeric film wraps the train and overlays the electroluminescent lamp unit to resist delamination when exposed to water, wherein the film has printed thereon advertising indicia;

connecting the lamp unit to a source of power on the train via the power bus; and switching the power source to control illumination of the planar electroluminescent lamp unit to shine through the at least partially translucent polymeric film.

15. The method of claim 14, further comprising powering the EL using a lighting sequence.

16. The method of claim 15, further comprising switching a plurality of switches according to the lighting sequence.

17. The method of claim 14, further comprising masking at least a portion of the planar electroluminescent lamp with the film.

18. The method of claim 17, wherein a portion of the film is translucent.

19. The method of claim 18, wherein a portion of the film is opaque.

20. The method of claim 19, wherein a portion of the film is clear.

* * * * *